US009810003B2

(12) United States Patent
Roychoudhury

(10) Patent No.: US 9,810,003 B2
(45) Date of Patent: Nov. 7, 2017

(54) IMPACT RESISTANT DOOR RETAINER FOR VEHICLE GLOVE BOX

(71) Applicant: FORD GLOBAL TECHNOLOGIES, LLC, Dearborn, MI (US)

(72) Inventor: Raj S. Roychoudhury, Bloomfield Hills, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 62 days.

(21) Appl. No.: 14/945,814

(22) Filed: Nov. 19, 2015

(65) Prior Publication Data

US 2017/0145720 A1 May 25, 2017

(51) Int. Cl.
*E05B 77/04* (2014.01)
*E05B 83/30* (2014.01)
*E05C 9/04* (2006.01)

(52) U.S. Cl.
CPC ..... *E05B 77/04* (2013.01); *E05B 83/30* (2013.01); *E05C 9/04* (2013.01)

(58) Field of Classification Search
CPC ..... E05B 77/04; E05B 83/30; E05B 83/32; E05B 1/0038; E05B 63/248; E05C 9/04; B60R 7/06; Y10S 292/37; Y10S 292/22; Y10S 292/11
See application file for complete search history.

(56) References Cited

U.S. PATENT DOCUMENTS 5,292,159 A 3/1994 Sandhu et al.
5,823,612 A 10/1998 Angelo
6,048,006 A * 4/2000 Antonucci ..... E05B 5/00 292/336.3
6,120,069 A * 9/2000 Taranto ..... E05B 83/30 292/166
6,802,550 B1 * 10/2004 Griggs, Jr. ..... B60N 2/4686 292/136
7,156,440 B2 * 1/2007 Katagiri ..... E05B 83/30 296/37.12
7,182,373 B2 * 2/2007 Yamada ..... E05B 83/30 292/141
7,287,785 B2 10/2007 Schupp et al.
(Continued)

FOREIGN PATENT DOCUMENTS

EP 1882611 A2 1/2008
KR 20040066357 A 7/2004

OTHER PUBLICATIONS

English machine translation of KR 20040066357.

*Primary Examiner* — Justin Rephann
(74) *Attorney, Agent, or Firm* — Vichit Chea; King & Schickli, PLLC

(57) ABSTRACT

An impact resistant releasable retainer is for a door, such as for covering a glove box or other vehicle storage compartment. A pawl retains the door closed and releases to allow the door to open. A pivotally mounted catch engages the pawl, such as within a notch, when the door is closed or moved in a forward direction, opposite the opening direction. An actuator moves the catch allowing the pawl to move, such as by engagement with the actuator following the engagement with the catch, for releasing the door to open. The catch otherwise remains secured to the pawl for preventing the inadvertent release of the door, such as during movement in the forward direction as the result of an impact.

17 Claims, 5 Drawing Sheets

(56) References Cited

U.S. PATENT DOCUMENTS 7,451,628 B1 * 11/2008 Kim ..... E05B 83/30 292/142
7,506,902 B2 * 3/2009 Sheng ..... G03G 21/1666 16/221
7,559,585 B2 * 7/2009 Plesternings ..... B60J 7/1851 292/201
7,607,727 B2 * 10/2009 Park ..... B60N 2/4686 292/131
7,832,239 B2 * 11/2010 Kozuka ..... E05B 83/30 292/39
8,191,953 B2 * 6/2012 Simon ..... B60N 2/4686 292/DIG. 22
8,353,549 B2 * 1/2013 Buchheit ..... E05B 83/30 292/33
2006/0208506 A1 9/2006 Kern et al.
2007/0205627 A1 * 9/2007 Ishiguro ..... E05B 83/30 296/100.1
2008/0022730 A1 * 1/2008 Dietrich ..... E05B 63/24 70/158
2008/0136193 A1 * 6/2008 Oh ..... B60R 7/06 292/164
2008/0290685 A1 * 11/2008 Ohnuki ..... E05B 1/0038 296/76
2009/0038352 A1 * 2/2009 Yamaguchi ..... B60R 7/06 70/237
2009/0206625 A1 * 8/2009 Toppani ..... B60R 7/06 296/37.12
2010/0071424 A1 * 3/2010 Tsuruta ..... E05B 63/248 70/91
2011/0018286 A1 * 1/2011 Mitchell, Jr. ..... B60R 7/06 292/173
2011/0025074 A1 * 2/2011 Reznar ..... E05B 5/00 292/33
2011/0309640 A1 * 12/2011 Matsubara ..... E05B 63/248 292/159
2012/0043778 A1 * 2/2012 Brant ..... B60R 7/04 296/24.34
2012/0112489 A1 * 5/2012 Okimoto ..... B60R 7/06 296/37.12
2015/0008680 A1 * 1/2015 Suzuki ..... B60R 7/06 292/32
2015/0028602 A1 * 1/2015 Shimizu ..... E05B 63/20 292/95
2015/0137527 A1 * 5/2015 Hattori ..... E05B 81/06 292/144
2015/0240539 A1 * 8/2015 Abe ..... B60R 7/06 296/37.12
2016/0024821 A1 * 1/2016 Aselage ..... E05B 83/30 292/32
2016/0097225 A1 * 4/2016 Tamaki ..... E05B 83/30 292/137

* cited by examiner

IMPACT RESISTANT DOOR RETAINER FOR VEHICLE GLOVE BOX

TECHNICAL FIELD

This document relates generally to the vehicle arts and, more particularly, to a door retainer, such as for a glove box, which is adapted to prevent the unintended release of the door to an open condition in the event of an impact, but which does not interfere with the normal opening and closing of the door in the intended manner.

BACKGROUND

Storage compartments such as glove boxes are a common component of vehicles. In the case of a glove box, the door is most often designed to mount flush with an instrument panel when the door is in a closed position. Behind the door is a storage compartment for holding personal items, for example, gloves, maps, flashlights, and vehicle manuals.

The glove box door is often held in place using opposed, releasable pawls, which engage a structure adjacent to the door. To open the door, these pawls may be released from engagement using an actuator, such as a button exposed to a vehicle occupant. During an external impact on the door, such as by way of contact with the vehicle occupant during a crash, the pawls may release. This may result in the door opening unintentionally and spilling the contents of the glove box.

This document relates to a retainer that aids in preventing a door from opening in the event of an impact, without interfering with the normal operation.

SUMMARY

In accordance with the purposes and benefits described herein, a releasable retainer for a door, such as for covering a glove box, is provided. The retainer comprises a pawl for retaining the door closed and releasing to allow the door to open. The pawl includes a notch, and a pivotally mounted catch is provided for engaging the notch when the door is closed or moved in a forward direction. An actuator serves to move the catch from engagement with the notch. This may be done in connection with (and prior to) the actuator engaging with the pawl for releasing the door to open.

In one embodiment, the catch is biased to remain engaged with the notch to maintain the door closed when the door moves in a direction transverse to a direction of movement of the actuator for releasing the pawl. The catch may comprise a first portion for extending into the notch when the door is closed and a second portion mounted about a pivot point for disconnecting the first portion from the notch to allow the door to open. The catch may further include an intermediate portion adapted for being engaged by the actuator to remove the hook from the notch.

The catch may be generally U-shaped, including two legs and a transverse portion connecting the legs. In such case, the notch may comprise a channel in the pawl for receiving the transverse portion of the catch. The catch may comprise a hook including a protrusion for engaging the notch, which comprises a bore in the pawl.

The actuator may comprise a plunger mounted for selectively engaging and moving the pawl from a first position for retaining the door closed to a second position for withdrawing the catch and releasing the door to open. The actuator may further comprise a button for causing the plunger to move in the intended manner, which button is accessible to a person in an interior compartment of a vehicle including the door.

A further aspect of the disclosure relates to an apparatus for providing access to a storage compartment. The apparatus comprises a door for providing access to the storage compartment when opened in a first direction. A first pawl is provided for retaining the door closed, and a pivotally mounted catch is for connecting with the first pawl. An actuator is provided for releasing the catch from the pawl and for moving the pawl to allow the door to open. The catch is adapted to remain in engagement with the first pawl when the door is moved opposite the first direction.

In one embodiment, the door comprises an opening for at least partially receiving the first pawl. The catch may be biased to remain engaged with the first pawl to maintain the door closed. The catch may comprise a first portion for extending into a notch on the pawl when the door is closed and a second portion mounted about a pivot point for withdrawing the first portion from the notch to allow the door to open.

The catch may include an intermediate portion adapted for being engaged by the actuator to remove the first portion of the catch from the notch. The catch may be generally U-shaped, including two legs and a transverse portion connecting the legs, and the notch may comprise a channel in the pawl for receiving the transverse portion of the catch. The catch may comprise a hook including a protrusion for engaging the notch, which comprises a bore in the pawl.

The apparatus may also include a second pawl for retaining the door closed and releasing to allow the door to open. The actuator may be further adapted for moving the second pawl for releasing the door to open. In one example, the actuator comprises a plunger mounted for selectively engaging and moving the first and second pawls from a first position for retaining the door closed to a second position for withdrawing the first catch and releasing the door to open.

Yet a further aspect of the disclosure relates to an apparatus for a vehicle with a storage compartment. The apparatus includes a door having a closed position for covering the storage compartment and an open position for providing access to the storage compartment, the door comprising an opening. A pawl at least partially passes through the opening in the door for engaging a structure for retaining the door in a closed position. A retainer is provided for connecting with the pawl when the door is in a closed position and for disconnecting from the pawl to allow the door to move to an open position. An actuator is also provided for releasing the retainer from the pawl to allow the door to move to the open position.

In the following description, there are shown and described several preferred embodiments of the glove box door retainer. As it should be realized, other, different embodiments may be realized (such as for use with other types of doors for compartments) and their several details are capable of modification in various, obvious aspects all without departing from the systems and method as set forth and described in the following claims. Accordingly, the drawings and descriptions should be regarded as illustrative in nature and not as restrictive.

BRIEF DESCRIPTION OF THE DRAWING FIGURES

The accompanying drawing figures incorporated herein and forming a part of the specification, illustrate several aspects of the releasable retainer for a glove box door and, together with the description, serve to explain certain principles thereof. In the drawing figures.

Figure 4:
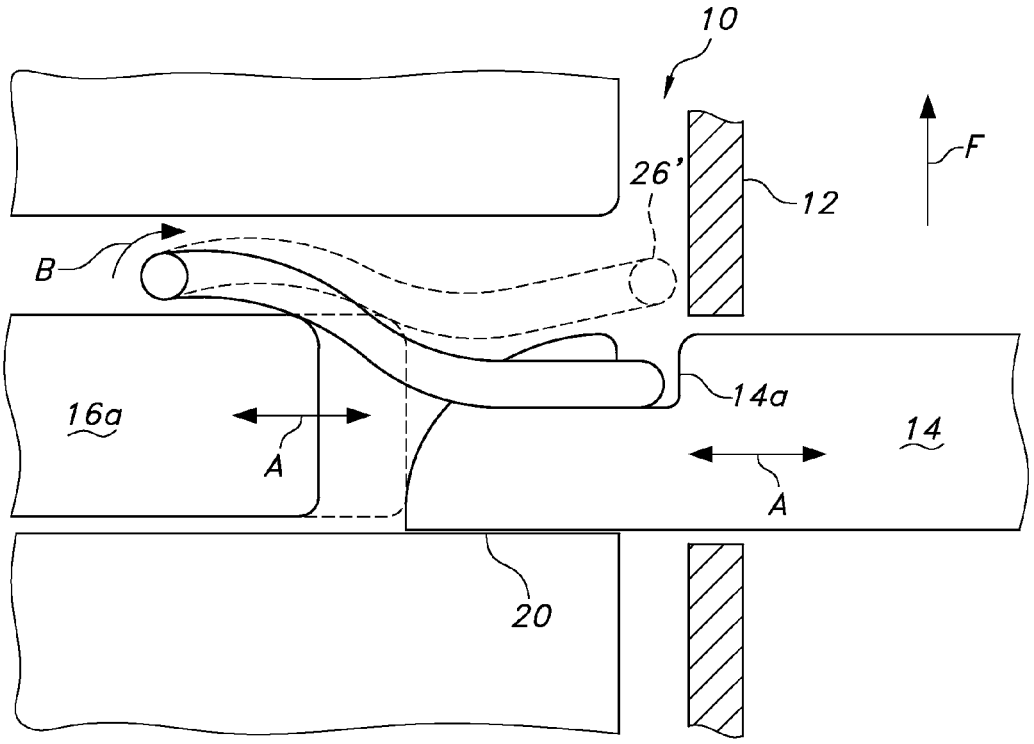
FIG. 4 is a cutaway, cross-sectional top view of one embodiment of the retainer.
Figure 4A:
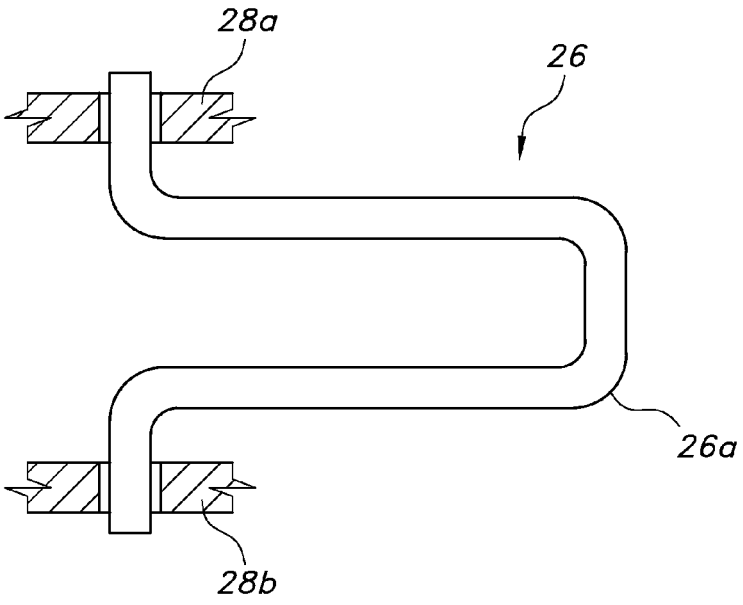
Figure 5:
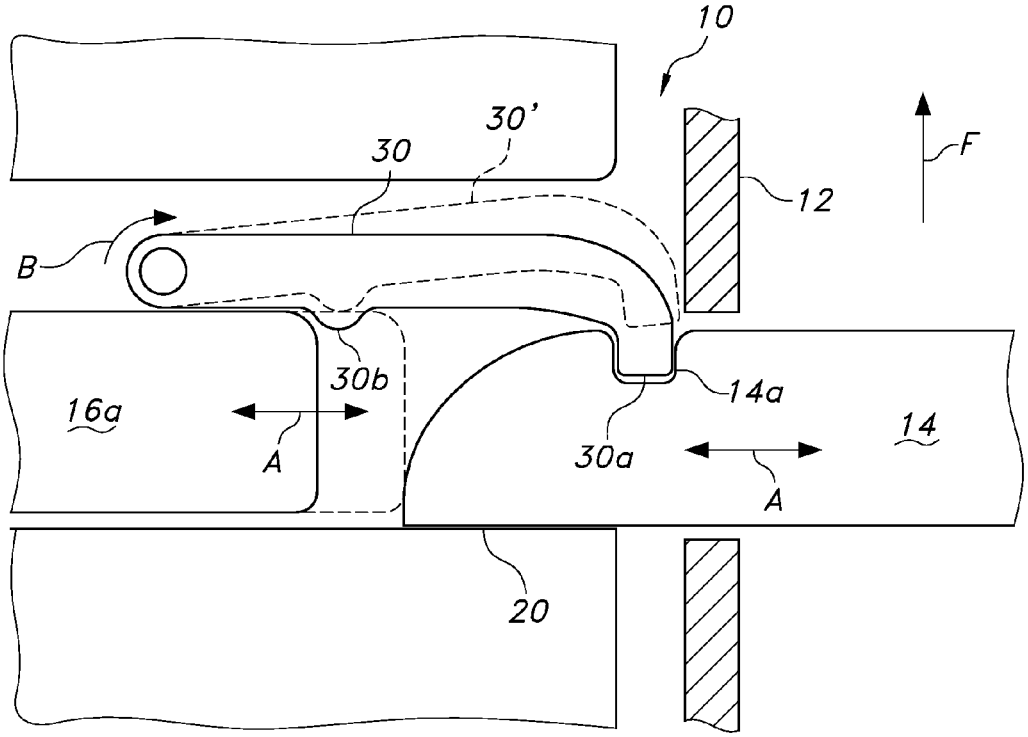
Figure 5A:
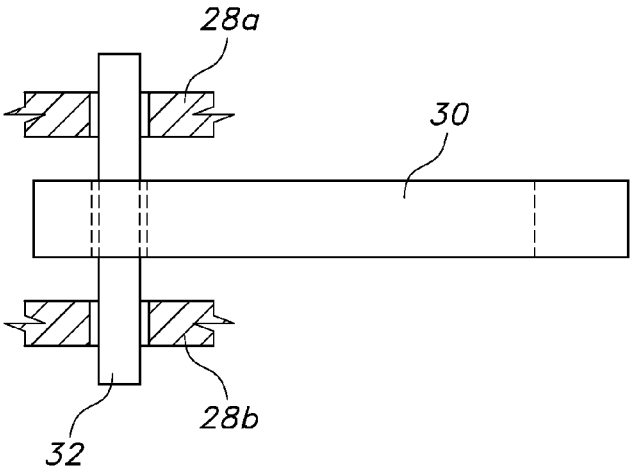
Figure 6:
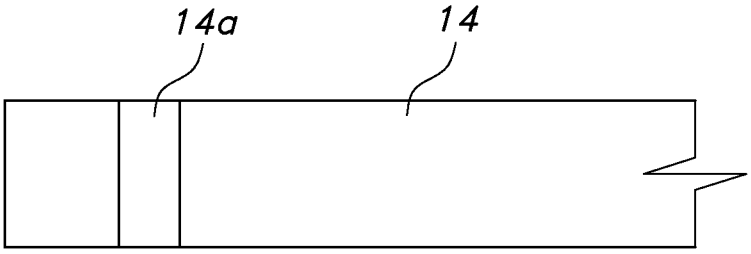

FIG. 4*a* is a top view of one embodiment of a catch;

FIG. 5 is a cutaway, cross-sectional top view of another embodiment of the retainer;

FIG. 5*a* is a top view of another embodiment of a catch;

FIG. 6 is a top view of the pawl of the embodiment of FIG. 4; and

Figure 7:
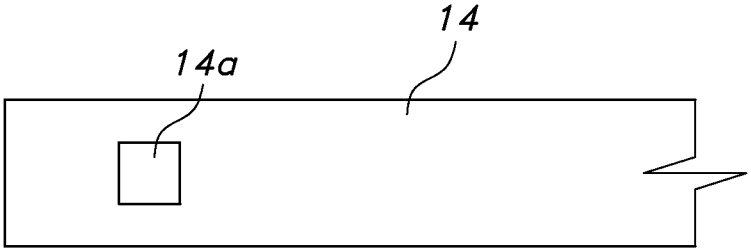

FIG. 7 is a top view of the pawl of the embodiment of FIG. 5.

Reference will now be made in detail to the present preferred embodiments of the glove box door retainer, examples of which are illustrated in the accompanying drawing figures.

DETAILED DESCRIPTION

Figure 1:
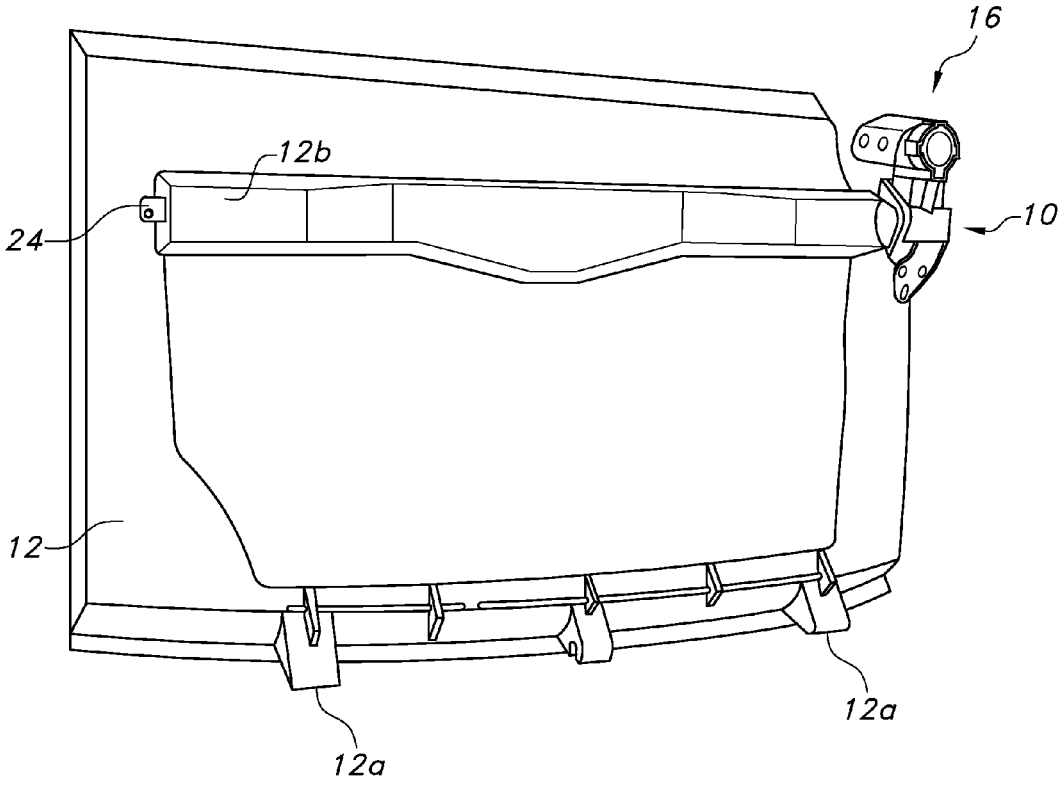
FIG. 1 is a rear elevational view of a glove box door that may benefit from including a releasable retainer according to the disclosure.

Reference is now made to FIG. 1 which broadly illustrates an embodiment of a releasable retainer 10 for a door 12 for covering a storage compartment. The storage compartment may, for example, be a glove box in a vehicle. However, use of the retainer 10 in other applications involving doors or covers is also possible, and the disclosure is not intended to limit use to any particular environment.

Figure 2:
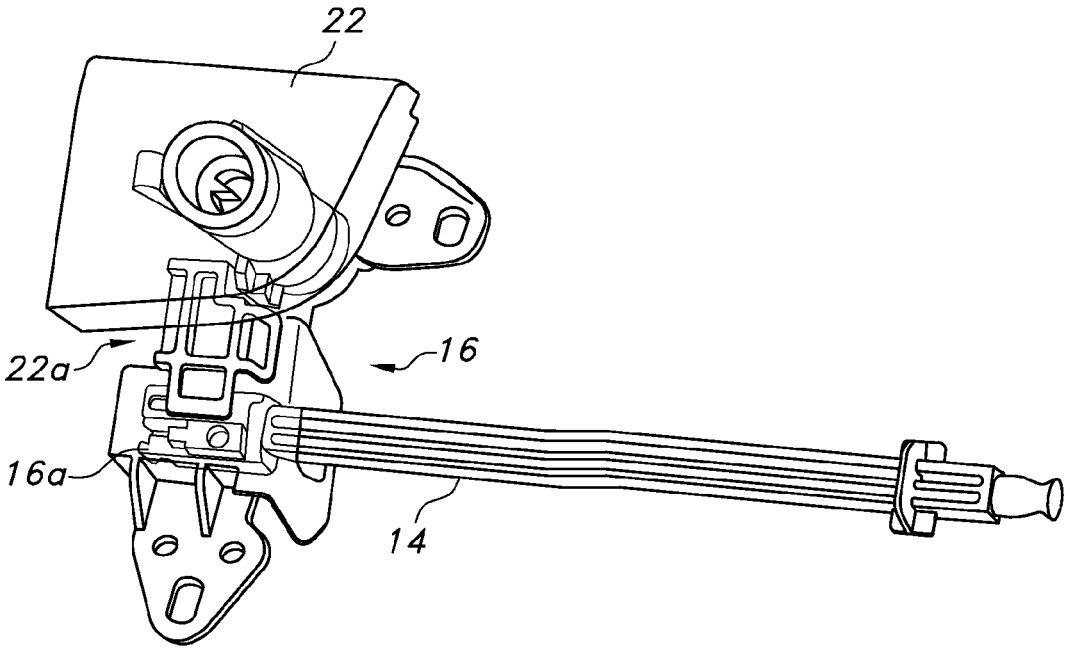
FIG. 2 is a perspective view of an actuator for releasing a pawl used to retain the door in a closed position.
Figure 3:
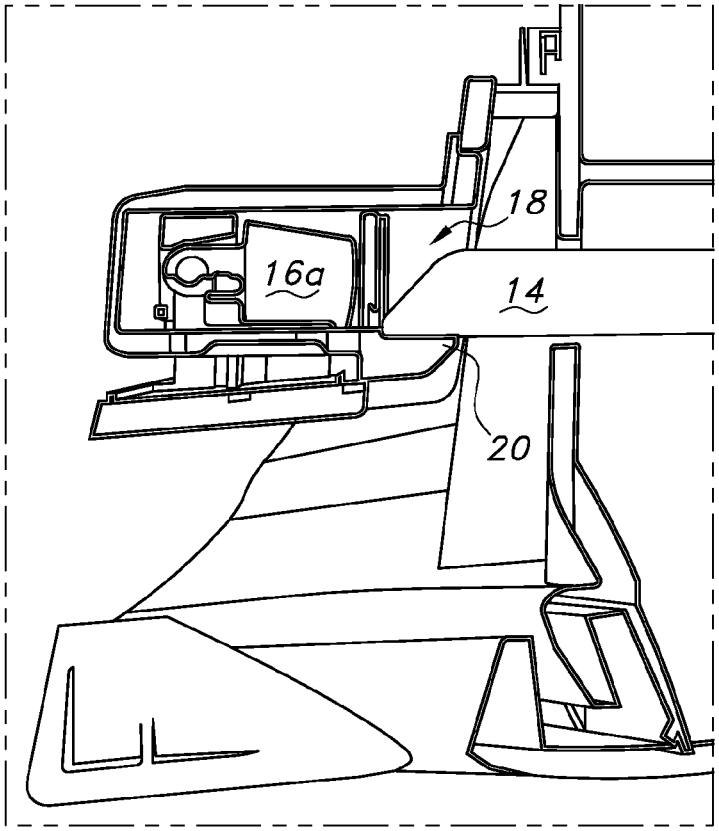
FIG. 3 is a cutaway, cross-sectional top view of the door of FIG. 1.

In the illustrated embodiment, and perhaps best understood with reference to FIGS. 2 and 3, a pawl 14 passes through an opening in the door 12 for engaging a stable structure separate from the door for retaining it in a closed (unpivoted) position (note hinges 12*a* to facilitate opening and closing of the door). An actuator 16 is provided for releasing the pawl 14 from the engaged condition, such as within a receiver 18 including a wall 20 for engaging the head end of the pawl 14. In the illustrated embodiment, the actuator 16 includes a movable (slidable) plunger 16*a* (which may also sometimes be referred to as a striker or pusher) for moving the pawl 14 to a position for allowing the door 12 to open. The plunger 16*a* may be arranged to move to and fro in the direction of action arrow A.

Movement of the plunger 16*a* to release the pawl 14 from engagement with the wall 20 may be caused by depressing an actuator in the form of a button 22. This button 22 may be exposed to a user in a vehicle including the storage compartment covered by the door 12. The movement of the button 22 in a forward direction (see reference character F in FIG. 4, which corresponds to the forward movement of the vehicle, and is opposite the direction in which the door 12 moves from the closed to the open condition) may be translated to movement in a transverse direction (such as indicated by arrow A) by a linkage 22*a*.

As can be understood from FIG. 1, a second pawl 24 may also be provided for latching the door 12 at an opposite side of the compartment. The second pawl 24 may be connected to the pawl 14 by a coupler (not shown), which may be housed in the body of the door 12 or in a housing 12*b* attached to it (which housing may include the opening of the door through which the pawl projects in the actuated condition for retaining the door in the closed position). As can be appreciated, the interconnected nature of the structures means that actuation of the pawl 14 via button 22 also causes the second pawl 24 to move (typically in the opposite direction as the result of coupler) to release and thus allow the door 12 to open.

With reference to FIG. 4, one aspect of this disclosure relates to the provision of a releasable retainer 10 for the door 12 including a catch 26 for retaining the pawl 14 (or pawl 24). As will be understood upon reviewing the description that follows, the retainer 10 serves to retain the door in the closed position when the actuator 16 is not actuated, yet the door is moved in the forward direction F (which, again, is opposite the direction in which the door opens, and transverse to the direction of movement of the plunger 16*a* when moving to and fro, as indicated by action arrow A). The retainer 10 thus serves to prevent the door 12 from opening and spilling the contents of the compartment in the event of an impact pushing the door in the forward direction, which might otherwise cause the pawl(s) 14, 24 to release inadvertently as a result of the movement.

In the embodiment shown in FIG. 4, the catch 26 comprises a U-shaped wire 26*a* mounted for pivoting movement between a position in which a portion of the wire is engaged in a notch 14*a* (which may comprise a channel or groove; see FIG. 6) associated with the pawl 14, and a position where the catch is not in engagement with this notch (reference numeral 26' in FIG. 4). As shown in the top down view of FIG. 4*a*, the wire 26*a* may include two legs connected by a transverse portion, and transverse feet that may be positioned between supports 28*a*, 28*b* in a manner that allows for relative pivoting movement in the forward direction F. The wire 26*a* may also be biased toward an engaged position with the notch 14*a* (that is, opposite the forward direction F), such as by using a torsion spring or like structure (not shown, but note biasing direction indicated by clockwise arrow B in FIGS. 4 and 5).

The wire 26*a* may also be adapted to be positioned in the path of the plunger 16*a* (such as by having a curved intermediate portion). Consequently, actuation of the plunger 16*a* serves to release the catch 26 from the notch 14*a*. With further movement in the actuation direction (aligned with arrow A), the plunger 16*a* also then moves the pawl 14 in the intended manner so that the door 12 may open (such as in a direction opposite the forward direction F). However, as can be appreciated, when the door 12 is moved in the forward direction F without activation of the plunger 16*a*, such as may occur during an external impact, the catch 26 remains in engagement with the notch 14*a*. This engagement thus prevents the door 12 from opening inadvertently, yet creates no interference with the normal operation when the button 22 is depressed to activate the plunger 16*a* and move the pawls 14, 24 to the release position.

A further example of a retainer 10 is shown in FIGS. 5 and 5*a*. In this embodiment, the catch 26 forming part of the retainer 10 takes the form of a hook 30, which may be pivotally mounted on a pin 32 extending between spaced supports 28*a*, 28*b*. The hook 30 may include a first protrusion 30*a* for engaging notch 14*a* (which as can be seen in FIG. 7, may comprise a bore in the body of the pawl 14), and a second protrusion 30*b* for engaging the actuator 16*a* when it is moved to the position associated with the opening of the door 12. Movement of the actuator 16*a* thus overcomes a biasing force retaining the protrusion 30*a* in the notch 14*a*, thus allowing the pawl 14 to release (with catch 30' shown dashed in the release position in FIG. 5), but the hook 30 otherwise remains engaged with the pawl to prevent inadvertent release.

In the illustrated embodiment, the pawls 14, 24 are connected such that movement of one impacts movement of the other. Hence, the catch 26 need only be provided on one of the pawls 14 or 24. The catch 26 in either embodiment may comprise a metal or rigid plastic material, or a combination of the two materials.

In summary, numerous benefits result from providing a retainer 10 for the door 12 according to the foregoing disclosure. The retainer 10 aids in preventing the door 12 from opening in the event of an impact. However, normal opening and closing of the door 12 is in no way impeded by the retainer 10, which as noted may take various forms.

The foregoing has been presented for purposes of illustration and description. It is not intended to be exhaustive or to limit the embodiments to the precise form disclosed. Obvious modifications and variations are possible in light of the above teachings. All such modifications and variations are within the scope of the appended claims when interpreted in accordance with the breadth to which they are fairly, legally and equitably entitled.

What is claimed:

1. A releasable retainer for a glove box door, comprising:

a pawl for retaining the door closed and releasing to allow the door to open, said pawl including a notch;

a pivotally mounted catch having a first portion extending into the notch when the door is closed and a second portion mounted about a pivot point; and an actuator for moving the first portion of the catch from the notch releasing the pawl and selectively engaging and moving said pawl from a first position in engagement with a structure for retaining the door closed to a second position to allow the door to open, wherein the catch is biased to maintain the first portion extending into the notch to maintain the door closed when the door moves in a direction transverse to a direction of movement of the actuator when releasing the catch.

2. The releasable retainer of claim 1, wherein the catch includes an intermediate portion adapted for being engaged by the actuator for moving the first portion of the catch from the notch.

3. The releasable retainer of claim 2, wherein said first portion includes a hook.

4. The releasable retainer of claim 2, wherein the catch is generally U-shaped, including two legs and a transverse portion connecting the legs.

5. The releasable retainer of claim 1, wherein the notch comprises a channel in the pawl for receiving the first portion of the catch.

6. The releasable retainer of claim 1, wherein the catch comprises a hook including a protrusion for engaging the notch.

7. The releasable retainer of claim 6, wherein the notch comprises a bore in the pawl.

8. A vehicle incorporating the releasable retainer of claim 1.

9. An apparatus for selectively covering a storage compartment, comprising:

a door for providing access to the storage compartment when opened in a direction;

a first pawl for retaining the door closed;

an actuator for moving the pawl to allow the door to open; and a catch having a first portion extending into a notch in the first pawl when the door is closed and a second portion mounted about a pivot point for withdrawing the first portion from the notch to allow the door to open, said catch engaging the actuator to move the first portion of the catch from the notch to release the first pawl when the door is opened.

10. The apparatus of claim 9, wherein the door comprises an opening for at least partially receiving the first pawl.

11. The apparatus of claim 9, wherein the catch is biased to remain engaged with the first pawl.

12. The apparatus of claim 9, wherein the catch includes an intermediate portion adapted for being engaged by the actuator to remove the first portion of the catch from the notch.

13. The apparatus of claim 9, wherein the catch is generally U-shaped, including two legs and a transverse portion connecting the legs, and the notch comprises a channel in the first pawl for receiving the transverse portion of the catch.

14. The releasable retainer of claim 9, wherein the catch comprises a hook including a protrusion for engaging the notch, which comprises a bore in the first pawl.

15. The apparatus of claim 9, further including:

a second pawl for retaining the door closed and releasing to allow the door to open; and wherein the actuator is further adapted for moving the second pawl for releasing the door to open.

16. The apparatus of claim 15, wherein the actuator comprises a plunger mounted for selectively engaging and moving the first and second pawls from a first position for retaining the door closed to a second position for withdrawing the first catch and releasing the door to open.

17. A vehicle including the apparatus of claim 9.

* * * * *